US010632742B2

(12) United States Patent
Anderson et al.

(10) Patent No.: US 10,632,742 B2
(45) Date of Patent: Apr. 28, 2020

(54) NOZZLE SENSOR EVALUATION

(71) Applicant: HEWLETT-PACKARD DEVELOPMENT COMPANY, L.P., Spring, TX (US)

(72) Inventors: Daryl E Anderson, Corvallis, OR (US); Eric Martin, Corvallis, OR (US); James Michael Gardner, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/349,688

(22) PCT Filed: Feb. 27, 2017

(86) PCT No.: PCT/US2017/019777
§ 371 (c)(1),
(2) Date: May 14, 2019

(87) PCT Pub. No.: WO2018/156171
PCT Pub. Date: Aug. 30, 2018

(65) Prior Publication Data

US 2019/0366707 A1 Dec. 5, 2019

(51) Int. Cl.
*B41J 2/045* (2006.01)
*B41J 2/14* (2006.01)

(52) U.S. Cl.
CPC ..... *B41J 2/04541* (2013.01); *B41J 2/0458* (2013.01); *B41J 2/14153* (2013.01)

(58) Field of Classification Search
CPC ... B41J 2/04541; B41J 2/14153; B41J 2/0458
See application file for complete search history.

(56) References Cited

U.S. PATENT DOCUMENTS

| | | | | |
|---|---|---|---|---|
| 4,463,359 | A | 7/1984 | Ayata et al. | |
| 5,621,524 | A | 4/1997 | Mitani | |
| 5,842,258 | A | 12/1998 | Harvey et al. | |
| 6,764,168 | B1 | 7/2004 | Meinhold et al. | |
| 7,695,091 | B2 | 4/2010 | Sheahan et al. | |
| 8,556,364 | B2 | 10/2013 | Hoisington et al. | |
| 2014/0333694 | A1* | 11/2014 | Martin | B41J 2/14153 347/19 |
| 2017/0001433 | A1* | 1/2017 | Anderson | B41J 2/14153 |
| 2017/0043572 | A1* | 2/2017 | Anderson | B41J 2/16579 |
| 2018/0022091 | A1* | 1/2018 | Alzona | B41J 2/0451 347/20 |

FOREIGN PATENT DOCUMENTS

| | | | | |
|---|---|---|---|---|
| CA | 2662724 C | 4/2008 | | |
| SG | 187483 | 2/2013 | | |
| WO | WO-200061372 | 10/2000 | | |
| WO | WO-2016175740 A1 * | 11/2016 | | B41J 2/195 |

* cited by examiner

*Primary Examiner* — Sharon A. Polk
(74) *Attorney, Agent, or Firm* — Mahamedi Paradice LLP

(57) ABSTRACT

A fluid ejection die including a plurality of drive bubble devices, a sensor operatively connected to each drive bubble device, and a current source connected to each sensor. Furthermore, the fluid ejection die may include an evaluation logic connected to each sensor and an impedance element. The evaluation logic can be configured to selectively connect the current source, through the impedance element, to the sensor.

15 Claims, 6 Drawing Sheets

NOZZLE SENSOR EVALUATION

BACKGROUND

Fluid ejection dies may be implemented in fluid ejection devices and/or fluid ejection systems to selectively eject/dispense fluid drops. Example fluid ejection dies may include nozzles, ejection chambers and fluid ejectors. In some examples, the fluid ejectors may eject fluid drops from an ejection chamber out of the nozzle.

BRIEF DESCRIPTION OF THE DRAWINGS

The disclosure herein is illustrated by way of example, and not by way of limitation, in the figures of the accompanying drawings in which like reference numerals refer to similar elements, and in which.

Figure 1A:
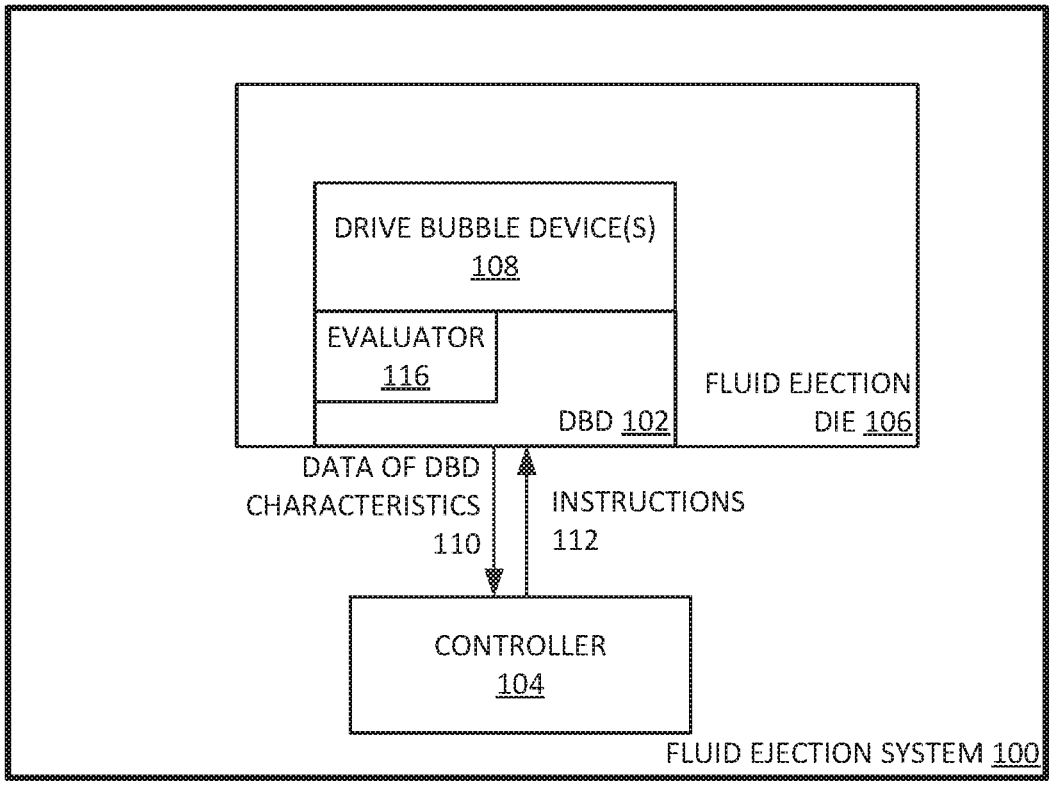
FIG. 1A illustrates an example fluid ejection system to evaluate a drive bubble device.

Throughout the drawings, identical reference numbers designate similar, but not necessarily identical elements. The figures are not necessarily to scale, and the size of some parts may be exaggerated to more clearly illustrate the example shown. Moreover the drawings provide examples and/or implementations consistent with the description. However, the description is not limited to the examples and/or implementations provided in the drawings.

DETAILED DESCRIPTION

Examples provide include an evaluation logic for a fluid ejection system to evaluate a nozzle sensor control logic of the fluid ejection system's fluid ejection die. The evaluation logic can include a controller configured to control the states of switches (e.g. open or close) in order to determine whether the components of the nozzle sensor control logic are working properly. In some examples, the nozzle sensor control logic includes DBD (drive bubble detect) circuitry.

Examples recognize that testing nozzle sensor control logic and an analog current source of the fluid ejection die at the wafer functional test level can be beneficial. The only other time detection of a malfunctioning nozzle sensor control logic and/or analog current source of the fluid ejection die is when the nozzle sensor control logic and the analog current source has been built into a fully functional and ink filled fluid ejection die. Meaning, the manufacturer can incur significant costs when discovering a faulty fluid ejection die, if the only defective parts were the nozzle sensor control logic and/or analog current source. To make matters more complicated, testing nozzle sensor control logic and analog current sources of the fluid ejection die without ink can reveal little or nothing because the response signal can go to maximum voltage (air has high resistance). Among other benefits, examples are described that enable a fluid ejection system to determine the state of operability of the nozzle sensor control logic at the wafer functional test level.

System Description

FIG. 1A illustrates an example fluid ejection system to evaluate a drive bubble device. As illustrated in FIG. 1A, fluid ejection system 100 can include controller 104 and fluid ejection die 106. Controller 104 can be configured to implement processes and other logic to manage operations of the fluid ejection system 100. For example, controller 104 can monitor the circuitry of DBD (drive bubble detect) 102 in order to determine or evaluate whether DBD 102 is working properly. In some examples, DBD 102 can include sensor control logic and the sensor control logic can include DBD circuitry. The DBD circuitry can include control components for the DBD circuitry. In such examples, DBD 102 can include evaluator 116. Evaluator 116 can include evaluation logic or circuitry, in which controller 104 can configure or utilize, to test and monitor the control components for the DBD circuitry. As such, controller 104 can test and monitor the control components of DBD 102, in order to determine the state of operability of the control components of DBD 102 (e.g. whether the control components of DBD 102 are working properly). In other examples, the control components of DBD 102 can include an analog current source. In some examples, controller 104 can test and monitor the control components of DBD 102 without the presence of fluid. Meaning controller 104 can test the control components of DBD 102 at the wafer functional test level, prior to building the DBD control circuitry into a fully functional and fluid filled fluid ejection die 106. In some examples, DBD 102 can include two additional switches so that controller 104 can test the operability of the control components of DBD 102. In some examples, controller 104 can include one or more processors to implement the described operations of fluid ejection-system 100.

In some examples, controller 104 can communicate with fluid ejection die 106 to fire/eject fluid out of drive bubble device(s) 108. As herein described, any fluid, for example fluid, can be used can be fired out of drive bubble device(s) 108. In other examples, controller 104 can transmit instructions 112 to DBD 102 to make assessments on drive bubble device(s) 108. In other examples, controller 104 can transmit instructions 112 to fluid ejection die 106 to implement servicing or pumping of drive bubble device(s) 108. In yet other examples, controller 104 can transmit instructions 112 to DBD 102 to make assessments, and fluid ejection die 106 to implement servicing of drive bubble device(s) 108 while DBD 102 is making assessments.

Drive bubble device(s) 108 can include a nozzle, a fluid chamber and a fluid ejection component. In some examples, the fluid ejection component can include a heating source. Each drive bubble device can receive fluid from a fluid reservoir. In some examples, the fluid reservoir can be ink feed holes or an array of ink feed holes. In some examples, the fluid can be ink (e.g. latex ink, synthetic ink or other engineered fluidic inks).

Fluid ejection system 100 can fire fluid from the nozzle of drive bubble device(s) 108 by forming a bubble in the fluid chamber of drive bubble device(s) 108. In some examples, the fluid ejection component can include a heating source. In such examples, fluid ejection system 100 can form a bubble in the fluid chamber by heating the fluid in the fluid chamber with the heat source of drive bubble device(s) 108. The bubble can drive/eject the fluid out of the nozzle, once the bubble gets large enough. In some examples, controller 104 can transmit instructions 112 to fluid ejection die 106 to drive a signal (e.g. power from a power source or current from the power source) to the heating source in order to create a bubble in the fluid chamber (e.g. fluid chamber 202). Once the bubble in the fluid chamber gets big enough, the fluid in the fluid chamber can be fired/ejected out of the nozzles of drive bubble device(s) 108.

In some examples, the heating source can include a resistor (e.g. a thermal resistor) and a power source. In such examples, controller 104 can transmit instructions 112 to fluid ejection die 106 to drive a signal (e.g. power from a power source or current from the power source) to the resistor of the heating source. The longer the signal is applied to the resistor, the hotter the resistor becomes. As a result of the resistor emitting more heat, the hotter the fluid gets resulting in the formation of a bubble in the fluid chamber.

Fluid ejection system 100 can make assessments of drive bubble device(s) 108 by electrically monitoring drive bubble device(s) 108. Fluid ejection system 100 can electrically monitor drive bubble device(s) 108 with DBD 102 and a DBD sensing component operatively communicating with drive bubble device(s) 108. DBD sensing component can be a conductive plate. In some examples DBD sensing component can be a tantalum plate. In some examples DBD sensing component can include a diode. For example, DBD sensing component can include a thermal sensitive diode.

In some examples, DBD 102 may electrically monitor the impedance of the fluid in drive bubble device(s) 108 during the formation and dissipation of the bubble in drive bubble device(s) 108. For instance, DBD 102 can be operatively connected to a DBD sensing component that itself is operatively connected to the fluid chamber of drive bubble device 108. In such a configuration, DBD 102 can drive a signal or stimulus (e.g. current or voltage) into the DBD sensing component in order to detect response signals (e.g. response voltages) of the formation and dissipation of the bubble in a drive bubble device. If the fluid chamber is empty, the remaining air has a high impedance, meaning the detected voltage response would be high. If the fluid chamber had fluid, the detected voltage response would be low because the fluid at a completely liquid state has a low impedance. If a steam bubble is forming in the fluid chamber, while a current is driven into the DBD sensing component, the detected voltage response would be higher than if the fluid in the fluid chamber were fully liquid. As the heating source gets hotter and more fluid vapors are generated, the voltage response increases because the impedance of the fluid increases. The detected voltage response would climax when the fluid from the fluid chamber is ejected from the nozzle. After which, the bubble dissipates and more fluid is introduced into the fluid chamber from reservoir.

In some examples, DBD 102 can drive the current (to the DBD sensing component) at precise times in order to detect one or more voltage responses, during the formation and dissipation of a bubble in the fluid chamber. In other examples, DBD 102 can drive a voltage to the DBD sensing component and monitor the charge transfer or voltage decay rate, during the formation and dissipation of a bubble in the fluid chamber 202.

Fluid ejection system 100 can determine the state of operability of the components of the drive bubble device, based on the assessments. In some examples, the data of the detected signal response(s) can be compared with a DBD signal response curve. In some examples, the signal response(s) are voltage responses. In other examples, the signal response(s) are the charge transfer or voltage decay rate. Based on the comparison, fluid ejection system 100 can determine the state of operability of the drive bubble device being DBD assessed (e.g. whether the components of the drive bubble device are working properly).

For example, controller 104 can determine the state of operability of drive bubble device(s) 108, based on data on DBD characteristics 110 transmitted from DBD 102. In some examples, data of DBD characteristics includes, the data of signal responses transmitted from DBD 102. Furthermore, controller 104 can compare data of signal responses to a DBD signal response curve. In some examples, the DBD signal response curve can include a signal response curve of a full functioning drive bubble device. If the data of signal responses is similar to the signal response curve of the full functioning drive bubble device, then controller 104 can determine that the DBD assessed drive bubble device 108 is working properly. On the other hand, if the data of signal responses and the signal response curve of the full functioning drive bubble device are not similar, then controller 104 can determine that the DBD assessed drive bubble device 108 is not working properly. In yet other examples, controller 104 can compare the data of signal responses to a signal response curve of a drive bubble device not working properly. If the data of signal responses and the signal response curve of the drive bubble device not working properly are similar, then controller 104 can determine that the DBD assessed drive bubble device 108 is not working properly.

Fluid ejection die 106 can include columns of drive bubble devices 108. In some examples, fluid ejection die 106 can include a column of drive bubble devices 108. Making a DBD (drive bubble detect) assessment of an entire fluid ejection die can take too long and the later assessed drive bubble devices on the fluid ejection die may have been idle too long and become too degraded to be able to undergo assessment. One approach to combat this problem, is by halting assessment of the entire fluid ejection die to service (e.g. eject/pump fluid currently in the drive bubble device or recirculate the fluid currently in the drive bubble device) the degraded drive bubble device. However such an approach extends the time for assessment and can even contribute to the degradation of the drive bubble device to degrade further. In some examples, fluid ejection system 100 can simultaneously perform an assessment of drive bubble device 108 and service the remaining drive bubble devices 108 not undergoing assessment. In other examples, fluid ejection device 100 can simultaneously perform an assessment of one drive bubble device 108 of one column of drive bubble devices and service all drive bubble devices 108 of the remaining columns not selected for assessment.

Figure 1B:
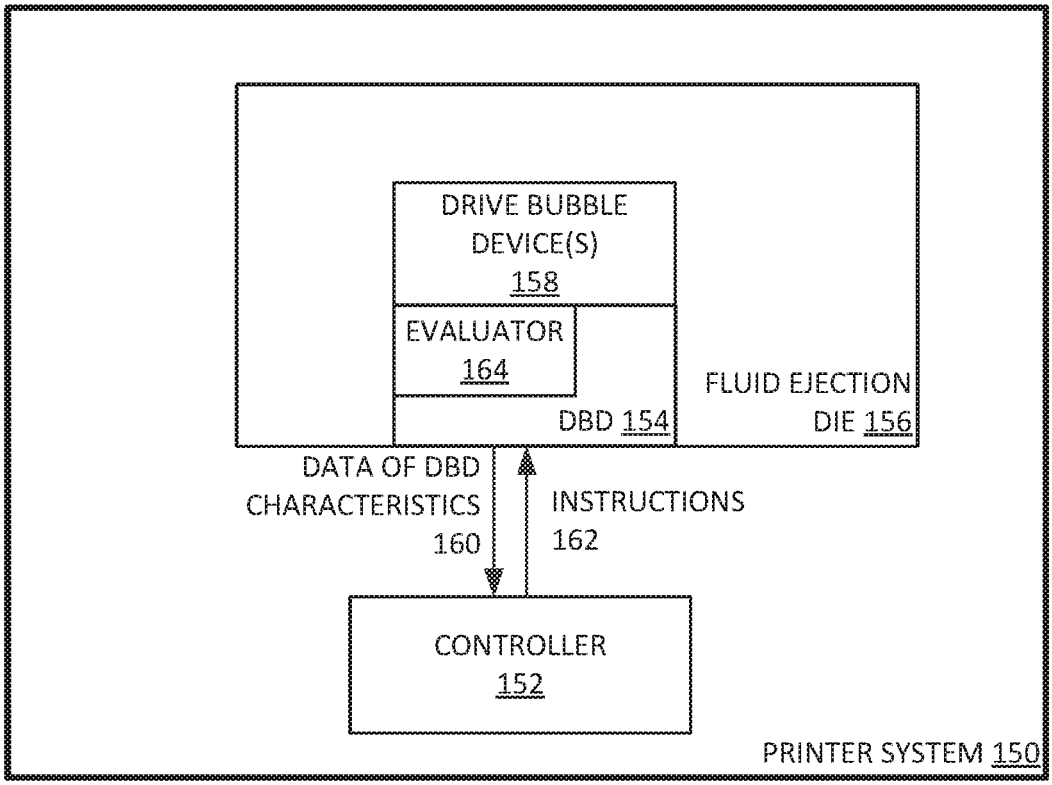
FIG. 1B illustrates an example printer system to evaluate a drive bubble device.

In some examples, fluid ejection die system 100 can be a printer system. FIG. 1B illustrates an example printer system to evaluate a drive bubble device. As illustrated in FIG. 1B, printer system 150 can include modules/components similar to fluid ejection system 100. For example, DBD 154 can include sensor control logic and the sensor control logic can include DBD circuitry. The DBD circuitry can include control components for the DBD circuitry. In some examples, DBD 154 can include evaluator 164. Evaluator 164 can include evaluation logic or circuitry, in which controller 152 can configure or utilize, to test and monitor the control components for the DBD circuitry. As such, controller 152 can test and monitor the control components of DBD 154, in order to determine the state of operability of the control components of DBD 154 (e.g. whether the control components of DBD 154 are working properly).

In other examples, controller 152 can evaluate the health and functionality of fluid ejection die 156 by controller 152 making assessments on drive bubble device(s) 158. Furthermore, while controller 152 is making assessments on drive bubble device(s) 158, controller 152 can instruct fluid ejection die 156 to concurrently implement servicing or pumping of other drive bubble device(s) 158.

Figure 2:
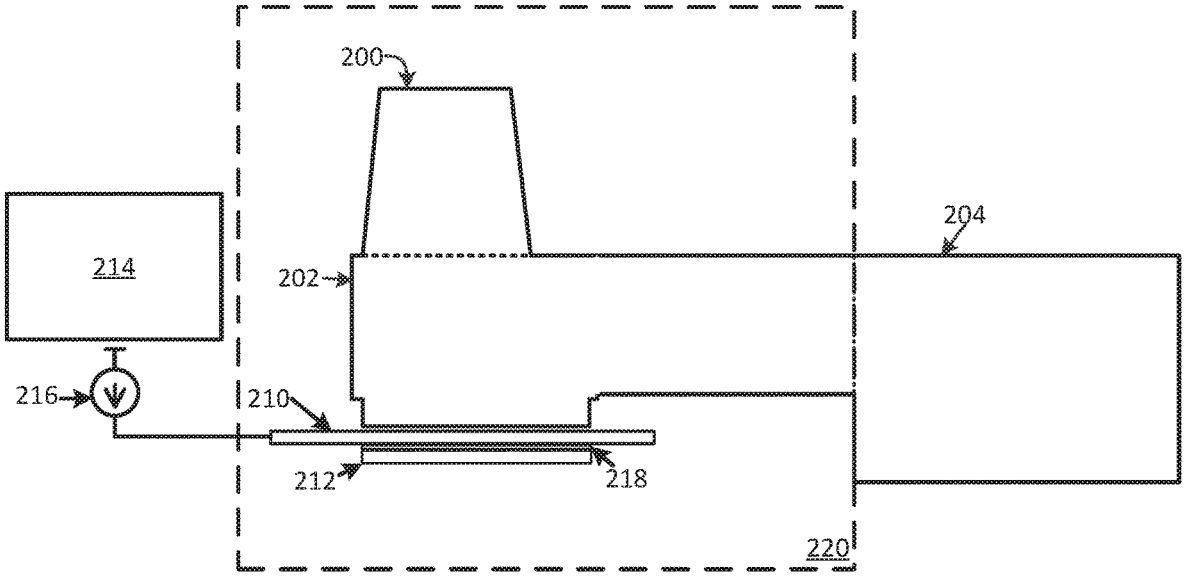
FIG. 2 illustrates an example cross-sectional view of an example drive bubble device including a nozzle, a nozzle sensor, and nozzle sensor control logic.

FIG. 2 illustrates an example cross-sectional view of an example drive bubble device including a nozzle, a nozzle sensor, and nozzle sensor control logic. As illustrated in FIG. 2, drive bubble device 220 includes nozzle 200, ejection chamber 202, and fluid ejector 212. In some examples, as illustrated in FIG. 2, fluid ejector 212 may be disposed proximate to ejection chamber 202.

Drive bubble device 220 can also include a DBD sensing component 210 operatively coupled to and located below fluid chamber 202. DBD sensing component can be a conductive plate. In some examples DBD sensing component 210 is a tantalum plate. As illustrated in FIG. 2, DBD sensing component 210 can be isolated from fluid ejector 212 by insulating layer 218.

In some examples, a fluid ejection die, such as the example of FIG. 1A, may eject drops of fluid from ejection chamber 202 through a nozzle orifice or bore of the nozzle 200 by fluid ejector 212. Examples of fluid ejector 212 include a thermal resistor based actuator, a piezo-electric membrane based actuator, an electrostatic membrane actuator, magnetostrictive drive actuator, and/or other such devices.

In examples in which fluid ejector 212 may comprise a thermal resistor based actuator, a controller can instruct the fluid ejection die to drive a signal (e.g. power from a power source or current from the power source) to electrically actuate fluid ejector 212. In such examples, the electrical actuation of fluid ejector 212 can cause formation of a vapor bubble in fluid proximate to fluid ejector 212 (e.g. ejection chamber 202). As the vapor bubble expands, a drop of fluid may be displaced in ejection chamber 202 and expelled/ejected/fired through the orifice of nozzle 200. In this example, after ejection of a fluid drop, electrical actuation of fluid ejector 212 may cease, such that the bubble collapses. Collapse of the bubble may draw fluid from fluid reservoir 204 into ejection chamber 202. In this way, in some examples, a controller (e.g. controller 104) can control the formation of bubbles in fluid chamber 202 by time (e.g. longer signal causes hotter resistor response) or by signal magnitude or characteristic (e.g. greater current on resistor to generate more heat).

In examples in which the fluid ejector 212 includes a piezoelectric membrane, a controller can instruct the fluid ejection die to drive a signal (e.g. power from a power source or current from the power source) to electrically actuate fluid ejector 212. In such examples, the electrical actuation of fluid ejector 212 can cause deformation of the piezoelectric membrane. As a result, a drop of fluid may be ejected out of the orifice of nozzle 200 due to the deformation of the piezoelectric membrane. Returning of the piezoelectric membrane to a non-actuated state may draw additional fluid from fluid reservoir 204 into ejection chamber 202.

Examples described herein may further comprise a nozzle sensor or DBD sensing component 210 disposed proximate ejection chamber 202. DBD sensing component 210 may sense and/or measure characteristics associated with the nozzle 200 and/or fluid therein. For example, the DBD sensing component 210 may be used to sense an impedance corresponding to the ejection chamber 202. In such examples, the nozzle sensor 210 may include a first sensing plate and second sensing plate. In some examples DBD sensing component 210 is a tantalum plate. As illustrated in FIG. 2, DBD sensing device 210 can be isolated from fluid ejector 212 by insulating layer 218. Based on the material disposed between the first and second sensing plates, an impedance may vary. For example, if a vapor bubble is formed proximate the nozzle sensor 210 (e.g. in fluid chamber 202), the impedance may differ as compared to when fluid is disposed proximate the nozzle sensor 210 (e.g. in fluid chamber 202). Accordingly, formation of a vapor bubble, and a subsequent collapse of a vapor bubble may be detected and/or monitored by sensing an impedance with the DBD sensing component 210.

A fluid ejection system can make assessments of drive bubble device 220 and determine a state of operability of the components of drive bubble device 220 (e.g. whether the components of drive bubble device 220 are working properly). For example, as illustrated in FIG. 2, nozzle sensor control logic 214 (including current source 216) can be operatively connected to DBD sensing component 210 to monitor characteristics of the drive bubble device, during the formation and dissipation of the a bubble in fluid chamber 202. For instance, some examples, nozzle sensor control logic 214 can be operatively connected to DBD sensing component 210 to electrically monitor the impedance of the fluid in fluid chamber 202 during the formation and dissipation of the bubble in fluid chamber 202. Nozzle sensor control logic 214 can drive a current from current source 216 into DBD sensing component 210 to detect a voltage response from fluid chamber 202 during the formation and dissipation of a bubble. In some examples, nozzle sensor control logic 214 can drive the current (to DBD sensing component 210) at precise times in order to detect one or more voltage responses, during the formation and dissipation of a bubble in fluid chamber 202. In other examples, nozzle sensor control logic 214 can drive a voltage to DBD sensing component 210 and monitor the charge transfer or voltage decay rate, during the formation and dissipation of a bubble in fluid chamber 202. Nozzle sensor control logic 214 can transmit data related to the voltage responses to a controller (e.g. controller 104) of the fluid ejection system (e.g. fluid ejection system 100). Similar to the principles described earlier, the controller can then determine the state of operability of drive bubble device 200, based on the received data. In some examples, nozzle sensor control logic 214 can include DBD circuitry. Furthermore, in such examples, the DBD circuitry can include control components of the DBD circuitry.

In some examples, the fluid ejection system can assess the state of operability of the control components of nozzle sensor control logic 214 (e.g. whether the control components of DBD circuit 214 are working properly). For example, nozzle sensor control logic 214 can include two additional switches so that the fluid ejection system (e.g. controller 104) can test the operability of the control components of nozzle sensor control logic 214 (including current source 216). In some examples, the fluid ejection system can test and monitor the control components of nozzle sensor control logic 214 without the presence of fluid. Meaning the fluid ejection system can test the control components of nozzle sensor control logic 214 at the wafer functional test level, prior to building nozzle sensor control logic 214 into a fully functional and fluid filled fluid ejection die.

Figure 3:
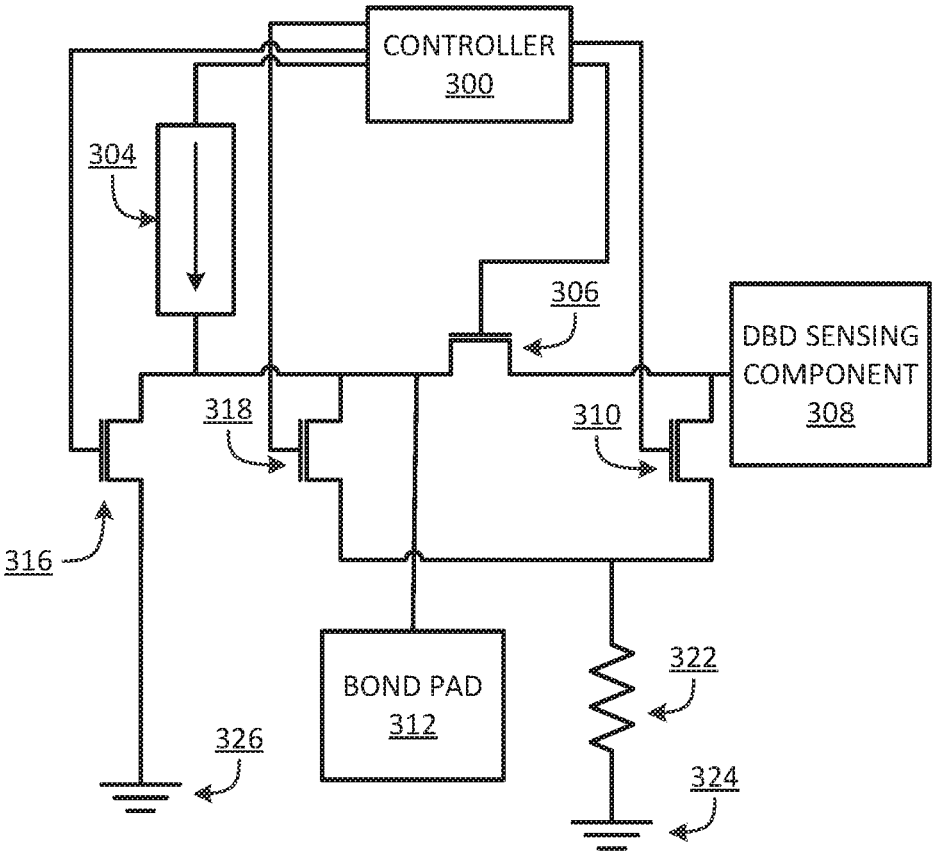
FIG. 3 illustrates an example circuit that can determine the state of operability of a DBD (drive bubble device) circuit without the presence of ink.

FIG. 3 illustrates an example circuit that can determine the state of operability of a DBD circuit without the presence of ink. The DBD circuit can include switch 306, switch 310, analog current source 304, and controller 300 (analogous to controller 104). Controller 300 is operatively connected to switch 306, switch 310 and the analog current source 304. Controller 300 can operatively control the states of switch 306 and 310 (e.g. open or close). In some examples, as illustrated by FIG. 3, the DBD circuit can be operatively connected to DBD sensing component 308.

In some examples, DBD 102 can include evaluator 116. Evaluator 116 can include logic or components that enable controller 104 to test the operability of the control components of DBD 102. For example, evaluator 116 can include two additional switches (e.g. JFET or MOSFET) so that controller 104 can test the operability of the control components of the DBD 102. As illustrated in FIG. 3, the DBD circuit can also include an additional two switches (e.g., evaluator 116)—switch 316 and switch 318. Controller 300 can be operatively connected to switch 316 and switch 318 and switch 316 to switch 306 and switch 318. Furthermore controller 300 can control the states of switch 316 and switch 318 (e.g. open and close). As shown in FIG. 3, switch 316 is also connected to ground 326. As such controller 300 can test the operability of the control components of the DBD 102, with the inclusion of switch 316 (to ground 326) and switch 318. Furthermore, in some examples, the DBD circuit can also include impedance element 322 to ground 324 that is connected to switch 310 and 318. In some examples, impedance element 322 can include a shunt resistor, transistor, diode, or any combination thereof. In other examples, a capacitance component can be connected in parallel to impedance element 322.

Fluid ejection system 100 can configure the circuitry of DBD 102 for assessments of drive bubble device(s) 108 or for evaluation. For example, as illustrated in FIG. 3, when the DBD circuitry is being used for assessments, controller 300 (similar to controller 104) can close switch 316 in order to force the current from current source 324 to go to ground. When the fluid ejection system (e.g. fluid ejection system 100) is evaluating the control components of the DBD circuitry, controller 300 can to open switch 316.

Fluid ejection system 100 can evaluate the state of operability of the analog current source of the DBD circuit (e.g. whether the analog current source is working properly). For example, as illustrated in FIG. 3, controller 300 (similar to controller 104) can open switch 316 and close switch 318. In some examples, if switch 306 is initially closed (e.g. because the DBD circuit was in assessment mode), then controller 300 can open switch 306 as well. In some examples, if switch 310 is initially closed (e.g. because the DBD circuit was in assessment mode), then controller 300 can open switch 310 as well. In other examples, controller 300 opens switch 306 and switch 310 before opening switch 316 and closing switch 318. In yet other examples, controller 300 opens switch 306 before opening switch 316 and closing switch 318, and opens switch 316 after closing switch 318. Based on the configuration, the current from analog current source 326 can go from switch 318 to impedance element 322 and then to ground 324. As a result, the voltage response can be detected through bond pad 312. In some examples, controller 300 can include logic that instructs controller 300 to detect the voltage response through bond pad 312 and compare it to a voltage profile of a fully functioning current source.

In some examples, controller 300 can determine the state of operability of analog current source 326, based on whether the detected rise in voltage matches the voltage profile of a fully functioning current source. Furthermore, if controller 300 can detect a rise in voltage, then controller 300 can also determine that switch 316 is working properly as well. In some examples, controller 300 can store data relating to the voltage profile of a fully functioning current source. In other examples, controller 104 can receive from a network service data relating to a voltage profile of a fully functioning current source.

Fluid ejection system 100 can evaluate the state of operability of the control switch of the DBD circuit (e.g. whether the control switch is working properly). In some examples, controller 300 can close switch 306, close switch 310, open switch 316 and open switch 318. In some examples, controller 300 simultaneously closes switch 306 and opens switch 316 simultaneously. In other examples, controller 306 simultaneously closes switch 306 and opens switch 316 after opening switch 318 and closing switch 310. In yet other examples, controller 306 opens switch 318 before closing switch 310, and simultaneously closing switch 306 and opening switch 316 after closing switch 310. Based on the configuration, the current from analog current source 326 can go from switch 306, to switch 310, to impedance element 322 and then to ground 324. As a result, controller 300 can detect a rise in the voltage response through bond pad 312 and compare it to a voltage profile of a fully functioning current source.

In some examples, controller 300 can determine the state of operability of switch 306 (e.g., the control switch), based on whether the detected rise in voltage matches the voltage profile of a fully functioning control switch. If switch 306 is not working properly (e.g. does not close), then the detected rise in the voltage response would be higher and the voltage would rise faster than the voltage profile of a fully functioning control switch (e.g. the voltage rails due to high impedance (basically the PSU voltage)). In some examples, controller 300 can store data relating to the voltage profile of a fully functioning switch 306. In other examples, controller 104 can receive from a network service data relating to a voltage profile of a fully functioning switch 306.

Methodology

Figure 4:
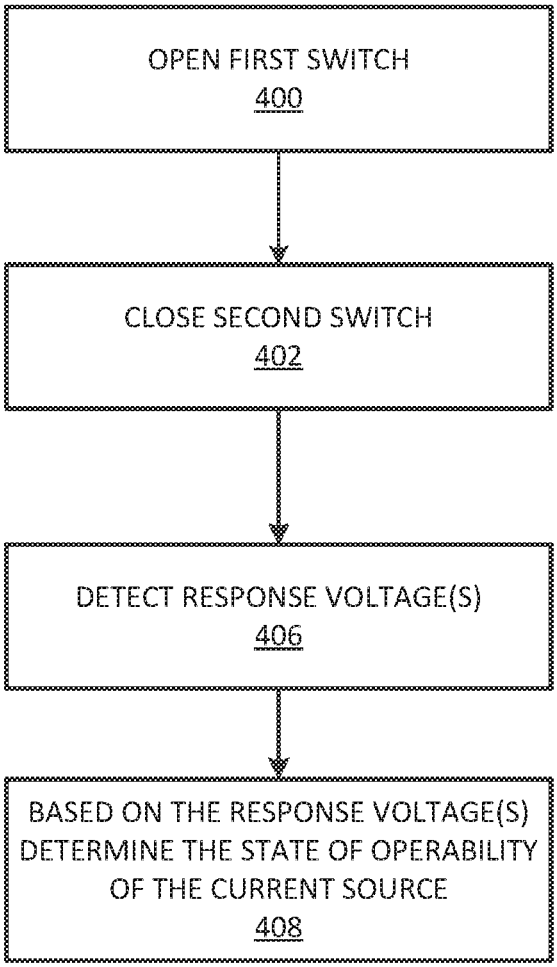
FIG. 4 illustrates an example method for determining the state of operability of a current source of a DBD circuit.
Figure 5:
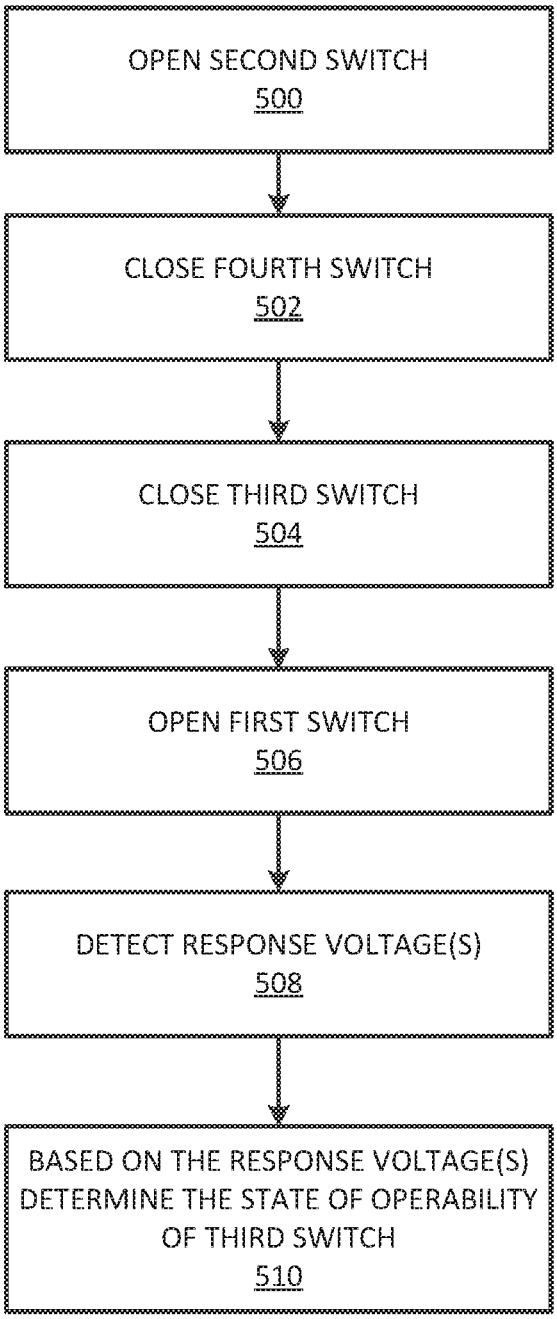
FIG. 5 illustrates an example method for determining the state of operability of a control switch of a DBD circuit.

FIG. 4 illustrates an example method for determining the state of operability of a current source of a DBD circuit. FIG. 5 illustrates an example method for determining the state of operability of a control switch of a DBD circuit. In the below discussions of FIGS. 4 and 5 reference may be made to reference characters representing like features as shown and described with respect to FIG. 1A, FIG. 1B, FIG. 2 and/or FIG. 3 for purpose of illustrating a suitable component for performing a step or sub-step being described.

With reference to FIG. 4, the fluid ejection system 100 (e.g. controller 104) can test the operability of an analog current source of DBD 102 (e.g. whether analog current source 326 is working properly or not) by transmitting instructions 112 to DBD 102 and evaluator 116 to open a first switch of DBD 102 (400) and close a second switch of DBD 102 (402). By way of example, the controller 300 can open switch 316 (e.g., the first switch) and closing switch 318 (e.g., the second switch). Prior to testing the operability of the components of the DBD circuit, controller 300 may close switch 316 in order to force the current from current source 324 to go to ground (e.g. because the DBD circuit was making Assessments of a drive bubble device). In other examples, if switch 306 (e.g., a third switch) is initially closed, then controller 300 can open switch 306. In some examples, if switch 310 (e.g., a fourth switch) is initially closed, then controller 300 can open switch 310 as well. In other examples, controller 300 opens switch 306 and 310, before opening switch 316 and closing switch 318. In yet other examples, controller 300 opens switch 306 before opening switch 316 and closing switch 318, and opens switch 316 after closing switch 318.

Controller 104 can determine the detected response voltage(s) from DBD 102 (404), based on the switch configuration. For example, as described above, under the switch configuration, the current from analog current source 326 can travel from switch 318 to impedance element 322 and then to ground 324. As a result, controller 300 can detect a rise in the voltage response through bond pad 312.

Controller 104 can determine the state of operability of the analog current source of DBD 102 based on the detected response voltage(s) (408). In some examples, as illustrated in FIG. 3, the controller (e.g. controller 104 or controller 300) can compare the detected rise in the voltage response to a voltage profile of a fully functioning current source. The controller (e.g. controller 104 or controller 300) can determine whether the analog current source of the DBD circuit (e.g. analog current source 326) is working properly based on whether the detected rise in voltage matches the voltage profile of a fully functioning current source. Furthermore, if the controller (e.g. controller 104 or controller 300) can determine a detection of the rise in the voltage response, then the controller can also determine that the first switch (e.g., switch 316) is working properly as well. In some examples, controller 104 can store data relating to the voltage profile of a fully functioning current source. In other examples, controller 104 can receive from a network service data relating to the voltage profile of a fully functioning current source.

With reference to FIG. 5, fluid ejection system 100 (e.g. controller 104) can test the operability of a control switch of DBD 102 (e.g. whether switch 306 is working properly or not) by transmitting instructions 112 to DBD 102 and evaluator 116 to open a first switch (500), open a second switch (502), close a third switch (504) and close a fourth switch (506). For example, as illustrated in FIG. 3, controller 300 (analogous to controller 102) can close switch 306 (e.g., the third switch), close switch 310 (e.g., the fourth switch), open switch 316 (e.g., the first switch) and open switch 318 (e.g., the second switch). In some examples, prior to testing the operability of the components of the DBD circuit, controller 300 can close switch 316 in order to force the current from current source 324 to go to ground. In some examples, controller 300 simultaneously closes switch 306 and opens switch 316 simultaneously. In other examples, controller 306 simultaneously closes switch 306 and opens switch 316 after opening switch 318 and closing switch 310. In yet other examples, controller 306 opens switch 318 before closing switch 310, and simultaneously closing switch 306 and opening switch 316 after closing switch 310.

Controller 104 can determine the detected response voltage(s) from DBD 102 (508), based on the switch configuration. In some examples, under the above described switch configuration, the current from analog current source 326 can travel from switch 306, to switch 310, to impedance element 322 and then to ground 324. As a result, controller 300 can detect a rise in the voltage response through bond pad 312 and compare it to a voltage profile of a fully functioning current source.

Controller 104 can determine the state of operability of the control switch of DBD 102 based on the detected response voltage(s). In some examples, the controller (e.g. controller 104 or controller 300) can determine whether the control switch (e.g. switch 306) is working properly (e.g. does not close), based on whether the detected rise in voltage matches the voltage profile of a fully functioning control switch. If control switch (e.g. switch 306) is not working properly (e.g. does not close), then the detected rise in the voltage response would be higher and the voltage would rise faster than the voltage profile of a fully functioning control switch (e.g., the voltage rails due to high impedance (basically the PSU voltage)). In some examples, controller 104 can store data relating to the voltage profile of a fully functioning control switch. In other examples, controller 104 can receive from a network service data relating to the voltage profile of a fully functioning current switch.

Although specific examples have been illustrated and described herein, it will be appreciated by those of ordinary skill in the art that a variety of alternate and/or equivalent implementations may be substituted for the specific examples shown and described without departing from the scope of the present invention. This application is intended to cover any adaptations or variations of the specific examples discussed herein. Therefore, it is intended that this invention be limited only by the claims and the equivalents thereof.

What is claimed is:

1. A fluid ejection die comprising:

a plurality of drive bubble devices; a sensor operatively connected to each drive bubble device of the plurality of drive bubble devices;

a current source connected to each sensor; and an evaluation logic connected to each sensor, each evaluation logic comprising an impedance element, each evaluation logic configured to selectively connect the current source through the impedance element to each sensor.

2. The fluid ejection die of claim 1, wherein the evaluation logic, further comprises a capacitance device connected to the impedance element in parallel.

3. The fluid ejection die of claim 1, wherein the evaluation logic comprises:

a first switch to selectively connect the current source to ground; and a second switch to selectively connect the current source through the impedance element to the sensor.

4. The fluid ejection die of claim 3, wherein the evaluation logic further comprises:

a third switch connected to the second switch and the sensor; and a fourth switch connected to the third switch and the impedance element.

5. The fluid ejection die of claim 4, wherein the evaluation logic can selectively connect the current source through the impedance element to the sensor by:

opening the first switch;

closing the second switch;

closing the third switch; and closing the fourth switch to detect one or more voltage responses, and based on the one or more voltage responses, determine a state of operability of the current source.

6. The fluid ejection die of claim 4, wherein the evaluation logic can selectively connect the current source through the impedance element to the sensor by:

opening the second switch;

closing the fourth switch;

closing the third switch; and opening the first switch, to detect one or more voltage responses and based on the detected one or more voltage responses, determine a state of operability of the third switch.

7. The fluid ejection die of claim 6, wherein the evaluation logic simultaneously closes the third switch and opens the first switch after closing the fourth switch.

8. The fluid ejection die of claim 1, wherein the impedance element is at least one of a resistor, transistor, diode, or any combination thereof.

9. A printer die comprising:

a plurality of drive bubble devices; a sensor operatively connected to each drive bubble device of the plurality of drive bubble devices;

a current source connected to each sensor; and an evaluation logic connected to each sensor, each evaluation logic comprising an impedance element, each evaluation logic configured to selectively connect the current source through the impedance element to each sensor.

10. The printer die of claim 9, wherein the evaluation logic, further comprises a capacitance device connected to the impedance element in parallel.

11. The printer die of claim 9, wherein the evaluation logic comprises:

a first switch to selectively connect the current source to ground; and a second switch to selectively connect the current source through the impedance element to the sensor.

12. The printer die of claim 11, wherein the evaluation logic further comprises:

a third switch connected to the second switch and the sensor; and a fourth switch connected to the third switch and the impedance element.

13. The printer die of claim 12, wherein the evaluation logic can selectively connect the current source through the impedance element to the sensor by:

opening the first switch;

closing the second switch;

closing the third switch; and closing the fourth switch to detect one or more voltage responses, and based on the one or more voltage responses, determine a state of operability of the current source.

14. The printer die of claim 12, wherein the evaluation logic can selectively connect the current source through the impedance element to the sensor by:

opening the second switch;

closing the fourth switch;

closing the third switch; and opening the first switch, to detect one or more voltage responses and based on the detected one or more voltage responses, determine a state of operability of the third switch.

15. The printer die of claim 14, wherein the evaluation logic simultaneously closes the third switch and opens the first switch after closing the fourth switch.

* * * * *